United States Patent [19]

Flaig

[11] Patent Number: 4,633,825

[45] Date of Patent: Jan. 6, 1987

[54] REED VALVE ASSEMBLY

[75] Inventor: John D. Flaig, Libertyville, Ill.

[73] Assignee: Outboard Marine Corporation, Waukegan, Ill.

[21] Appl. No.: 751,292

[22] Filed: Jul. 2, 1985

[51] Int. Cl.[4] ..... F02B 33/04

[52] U.S. Cl. ..... 123/73 V; 137/856

[58] Field of Search ..... 123/73 R, 73 V, 73 A, 123/73 C, 317, 318; 137/855, 856

[56] References Cited

U.S. PATENT DOCUMENTS

| | | | |
|---|---|---|---|
| 351,121 | 10/1886 | Meyer | 137/855 |
| 502,750 | 8/1893 | O'Neil | 251/364 |
| 1,011,922 | 12/1911 | Dalen | 251/364 |
| 1,216,528 | 2/1917 | Wickert, Jr. | 251/364 |
| 1,424,094 | 7/1922 | Gunn et al. | 251/364 |
| 3,008,459 | 11/1961 | Kaufman | 123/73 V |
| 3,115,155 | 12/1963 | Clark | 137/512.3 |
| 3,276,530 | 10/1966 | Borneman | 137/855 |
| 3,286,728 | 11/1966 | Stephenson | 137/855 |
| 3,905,391 | 9/1975 | Oakes | 137/855 |
| 4,071,000 | 1/1978 | Herbert | 123/73 V |
| 4,076,047 | 2/1978 | Akahori | 137/856 |
| 4,079,751 | 3/1978 | Partridge et al. | 251/364 |
| 4,082,295 | 4/1978 | Bainard | 123/73 V |
| 4,257,458 | 3/1981 | Kondo et al. | 137/855 |

FOREIGN PATENT DOCUMENTS

| | | | |
|---|---|---|---|
| 0013268 | 1/1983 | Japan | 137/855 |

*Primary Examiner*—Charles J. Myhre
*Assistant Examiner*—David A. Okonsky
*Attorney, Agent, or Firm*—Michael, Best & Friedrich

[57] ABSTRACT

A reed valve assembly comprising a valve member having a valve opening therein, a resilient valve seat member having an end and an opening registering with the valve opening and defining a valve seat surrounding the valve opening, a reed valve having an end, and a screw securing the ends of the reed valve and of the valve seat member to the valve member with the valve seat member secured between the reed valve and the valve member and with the reed valve movable into and out of engagement with the valve seat member to respectively close and open the valve opening.

7 Claims, 3 Drawing Figures

REED VALVE ASSEMBLY

BACKGROUND OF THE INVENTION

The invention relates to reed valve assemblies, and more particularly to reed valve assemblies used in two-cycle internal combustion engines.

Such reed valve assemblies typically include a reed plate, a reed valve and a reed valve stop all sandwiched together by a screw. Typically, the reed plate is made of aluminum, and the reed valve is made of steel. In prior reed valve assemblies, failure of the reed valve due to fatigue from striking the reed plate has been slowed by molding rubber or another soft, resilient material onto the reed plate. The rubber cushions the reed valve as it strikes the reed plate. Such a construction requires expensive molds and precision castings of reed plates.

Attention is directed to the following U.S patents which disclose valve assemblies:

| | |
|---|---|
| Meyer | 351,121 |
| O'Neil | 502,750 |
| Dalen | 1,011,922 |
| Wickert, Jr. | 1,216,528 |
| Gunn, et al. | 1,424,094 |
| Borneman | 3,276,530 |
| Oakes | 3,905,391 |
| Partridge, et al. | 4,079,751 |
| Kondo, et al. | 4,257,458 |
| Stephenson | 3,286,728 |

SUMMARY OF THE INVENTION

The invention provides a reed valve assembly comprising a valve member having a valve opening therein, a resilient valve seat member having an end and an opening registering with the valve opening and defining a valve seat surrounding the valve opening, a reed valve having an end, and means for securing the ends of the reed valve and of the valve seat member to the valve member with the valve seat member secured between the reed valve and the valve member and with the reed valve movable into and out of engagement with the valve seat member to respectively close and open the valve opening.

In one embodiment, the valve assembly further comprises a reed valve stop having an end, and the securing means further secures the end of the reed valve stop to the valve member with the reed valve secured between the reed valve stop and the valve seat member.

In one embodiment, the valve seat member has an opposite second end, and the valve assembly further comprises means for securing the second end of the valve seat member to the valve member.

In one embodiment, the valve member has therein an aperture, the second end of the valve seat member has therein an aperture aligned with the aperture in the valve member, and the means for securing the second end of the valve seat member includes a resilient grommet received in the aligned apertures.

In one embodiment, the securing means includes a screw extending through the ends of the reed valve and of the valve seat member and being threaded into the valve member.

The invention also provides a reed box comprising a reed plate having therein a valve opening, and an aperture, a resilient valve seat member having an opening registering with the valve opening and defining a valve seat surrounding the valve opening, a first end, and an opposite second end having therein an aperture aligned with the aperture in the reed plate, a reed valve having an end, a reed valve stop having an end, a screw extending through the first end of the valve seat member and the ends of the reed valve stop and of the reed valve and being threaded into the reed plate for securing the first end of the valve seat member and the ends of the reed valve and of the reed valve stop to the reed plate with the valve seat member secured between the reed valve and the reed plate, with the reed valve secured between the reed valve stop and the valve seat member, and with the reed valve movable into and out of engagement with the valve seat member to respectively close and open the valve opening, and a resilient grommet received in the aligned apertures for securing the second end of the valve seat member to the reed plate.

The invention also provides a two-cycle internal combustion engine comprising a crankcase including an intake opening and being subject to alternate conditions of relatively high and low pressure, and a reed box mounted in the intake opening to allow air flow into the crankcase through the intake opening and to prevent air flow out of the crankcase through the intake opening, the reed box including a reed plate having therein a valve opening, a resilient valve seat member having an end and an opening registering with the valve opening and defining a valve seat surrounding the valve opening, a reed valve having an end, and means for securing the ends of the reed valve and of the valve seat member to the reed plate with the valve seat member secured between the reed valve and the reed plate and with the reed valve movable into and out of engagement with the valve seat member to respectively close and open the valve opening.

A principal feature of the invention is the provision of a reed box comprising a resilient valve seat member, and means for securing the reed valve and the valve seat member to the reed box with the valve seat member secured between the reed valve and the reed box. This construction provides an inexpensive means for cushioning the reed valve.

Another principal feature of the invention is the provision of a resilient grommet securing the opposite end of the resilient valve seat member to the reed box. This provides further inexpensive means for retaining the valve seat member.

Other principal features and advantages of the invention will become apparent to those skilled in the art upon review of the following detailed description, claims, and drawings.

Figure 1:
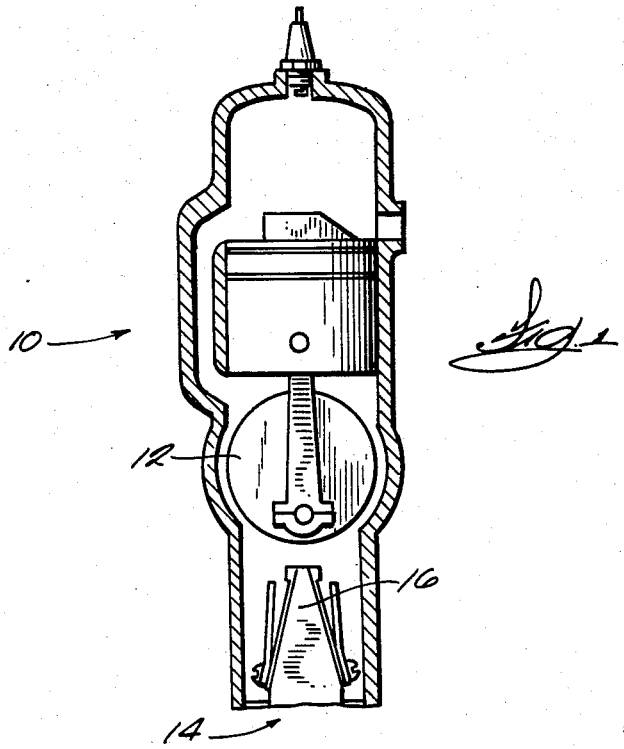
FIG. 1 is a side elevational view of a two-cycle internal combustion engine embodying the invention.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

A two-cycle internal combustion engine 10 embodying the invention is shown in FIG. 1. The engine 10 includes a crankcase 12 which includes an intake opening 14 and which is subject to alternate conditions of relatively high and low pressure. The engine 10 also includes a reed box 16 which is mounted in the intake opening 14 to allow air flow into the crankcase 12 through the intake opening 14 and to prevent air flow out of the crankcase 12 through the intake opening 14.

The reed box 16 comprises a pair of converging reed valve assemblies 18. Since the reed valve assemblies 18 are identical, only one will be described in detail.

The reed valve assembly 18 comprises a valve member or reed plate 20 having therein a valve opening 22 with first and second or left and right ends, and an aperture 24 adjacent the second or right end of the valve opening 22. The reed valve assembly 18 also comprises a resilient valve seat member 26 having an opening 25 registering with the valve opening 22 and defining a valve seat surrounding the valve opening 22. The member 26 has a first or left end adjacent the left end of the valve opening 22, and an opposite second or right end having therein an aperture 27 aligned with the aperture 24 in the reed plate 20. The reed valve assembly 18 further comprises a reed valve 28 having an end overlapping the left end of the valve seat member 26, and, preferably, a reed valve stop 30 having an end overlapping the end of the reed valve 28.

The reed valve assembly 18 further comprises means for securing the left end of the valve seat member 26 and the ends of the reed valve 28 and of the valve stop 30 to the reed plate 20 with the valve seat member 26 secured between the reed valve 28 and the reed plate 20, with the reed valve 28 secured between the reed valve stop 30 and the valve seat member 26, and with the reed valve 28 movable into and out of engagement with the valve seat member 26 to respectively close and open the valve opening 22. While various suitable securing means can be employed, in the preferred embodiment, the securing means includes a screw 32 extending through the left end of the valve seat member 26 and the ends of the reed valve stop 30 and of the reed valve 28 and being threaded into the reed plate 20.

Preferably, the reed valve assembly 18 further comprises means for securing the second or right end of the valve seat member 26 to the reed plate or valve member 20. While various suitable second end securing means can be used, in the illustrated construction, such means for both of the reed valve assemblies 18 includes a resilient grommet 34 received in the aligned apertures 24 and 27 of both reed valve assemblies 18 for securing the second ends of the valve seat members 26 to their respective reed plates 20.

In operation, the reed valves 28 alternately open and close in response to alternate conditions of relatively low and high pressure in the crankcase 12. As the crankcase 12 changes from high pressure to low pressure, the reed valves 28 move from a position against the valve seat members 26 to a position against the reed valve stops 30, thereby opening the valve openings 22 and thus the intake opening 14. As the crankcase 12 changes from low pressure to high pressure, the reed valves 28 move from the position against the reed valve stops 30 to the position against the valve seat members 26, thereby closing the valve openings 22 and thus the intake opening 14. The valve seat members 26 cushion the reed valves 28 as they close the valve openings 22.

Figure 3:
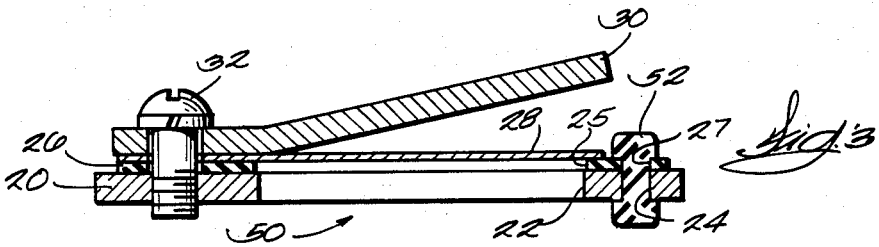
FIG. 3 is a cross-sectional view of an alternative embodiment of the invention.
Figure 2:
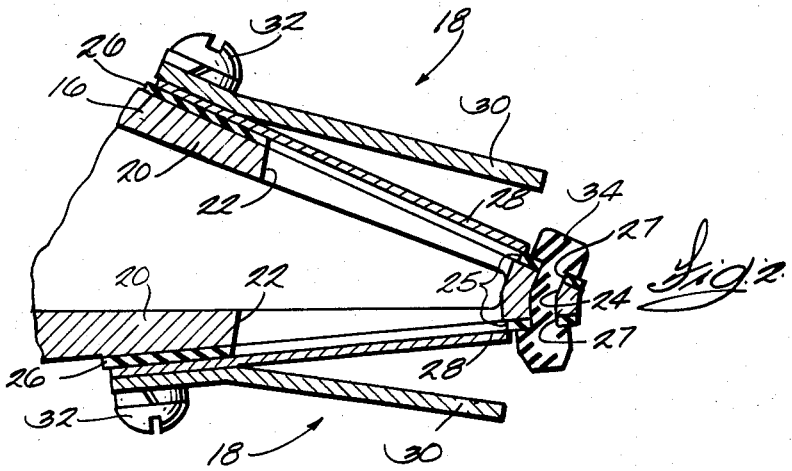
FIG. 2 is an enlarged, cross-sectional view of the reed box shown in FIG. 1.

A reed valve assembly 50 which is an alternative embodiment of the invention is illustrated in FIG. 3. Except for the means securing the second end of the valve seat member 26 to the reed plate 20, the reed valve assembly 50 shown in FIG. 3 is identical to the reed valve assemblies 18 shown in FIG. 2. In the embodiment shown in FIG. 3, the means for securing the second end of the valve seat 26 to the reed plate 20 includes a resilient grommet 52 extending only through the aligned apertures 24 and 27 of the single reed valve assembly 50.

Other features and advantages of the invention are set forth in the following claims.

I claim:

1. A reed valve assembly comprising a valve member having a valve opening therein, a resilient valve seat member having a first end, an opposite second end, and an opening registering with said valve opening and defining a valve seat surrounding said valve opening, a reed valve having an end, first means for securing said end of said reed valve and said first end of said valve seat member to said valve member with said first end of said valve seat member secured between said reed valve and said valve member and with said reed valve movable into and out of engagement with said valve seat member to respectively close and open said valve opening, and second means for securing said second end of said valve seat member to said valve member, wherein said valve member has therein an aperture, wherein said second end of said valve seat member has therein an aperture aligned with said aperture in said valve member, and wherein said means for securing said second end of said valve seat member includes a fastening means received in said aligned apertures.

2. A valve assembly as set forth in claim 1 and further comprising a reed valve stop having an end, and wherein said first securing means further secures said end of said reed valve stop to said valve member with said reed valve secured between said reed valve stop and said valve seat member.

3. A valve assembly as set forth in claim 1 wherein said first securing means includes a screw extending through said ends of said reed valve and of said valve seat member and being threaded into said valve member.

4. A reed box comprising a reed plate having therein a valve opening, and an aperture, a resilient valve seat member having an opening registering with said valve opening and defining a valve seat surrounding said valve opening, a first end, and an opposite second end having therein an aperture aligned with said aperture in said reed plate, a reed valve having an end, a reed valve stop having an end, a screw extending through said first end of said valve seat member and said ends of said reed valve stop and of said reed valve and being threaded into said reed plate for securing said first end of said valve seat member and said ends of said reed valve and of said reed valve stop to said reed plate with said valve seat member secured between said reed valve and said reed plate, with said reed valve secured between said reed valve stop and said valve seat member, and with said reed valve movable into and out of engagement with said valve seat member to respectively close and open said valve opening, and a resilient grommet received in said aligned apertures for securing said second end of said valve seat member to said reed plate.

5. A two-cycle internal combustion engine comprising a crankcase including an intake opening and being subject to alternate conditions of relatively high and low pressure, and a reed box mounted in said intake opening to allow air flow into said crankcase through said intake opening and to prevent air flow out of said crankcase through said intake opening, said reed box including a reed plate having therein a valve opening, a resilient valve seat member having a first end, an opposite second end, and an opening registering with said valve opening and defining a valve seat surrounding said valve opening, a reed valve having an end, first means for securing said end of said reed valve and said first end of said valve seat member to said reed plate with said first end of said valve seat member secured between said reed valve and said reed plate and with said reed valve movable into and out of engagement with said valve seat member to respectively close and open said valve opening, and second means for securing said second end of said valve seat member to said reed plate, wherein said reed plate has therein an aperture, wherein said second end of said valve seat member has therein an aperture aligned with said aperture in said reed plate, and wherein said means for securing said second end of said valve seat member includes a fastening means received in said aligned apertures.

6. An internal combustion engine as set forth in claim 5 and further comprising a reed valve stop having an end, and wherein said first securing means further secures said end of said reed valve stop to said reed plate with said reed valve secured between said reed valve stop and said valve seat member.

7. An internal combustion engine as set forth in claim 5 wherein said first securing means includes a screw extending through said ends of said reed valve and of said valve seat member and being threaded into said reed plate.

* * * * *